US006733345B2

(12) United States Patent
Weise et al.

(10) Patent No.: US 6,733,345 B2
(45) Date of Patent: May 11, 2004

(54) RUGGED ELECTRICAL JUNCTION BOX AND METHOD

(76) Inventors: Gary K. Weise, 1700 Barcelona Cir., Placentia, CA (US) 92870; Richard J. Kesl, 1700 Barcelona Cir., Placentia, CA (US) 92870

( * ) Notice: Subject to any disclaimer, the term of this patent is extended or adjusted under 35 U.S.C. 154(b) by 0 days.

(21) Appl. No.: 10/197,524

(22) Filed: Jul. 15, 2002

(65) Prior Publication Data

US 2004/0009713 A1 Jan. 15, 2004

(51) Int. Cl.[7] ..... H01R 9/22
(52) U.S. Cl. ..... 439/721; 174/50
(58) Field of Search ..... 439/339, 727, 439/801; 174/50

(56) References Cited

U.S. PATENT DOCUMENTS 4,623,753 A * 11/1986 Feldman et al. ..... 174/50
5,382,752 A * 1/1995 Reyhan et al. ..... 174/50
5,541,363 A * 7/1996 Weise et al. ..... 174/50

* cited by examiner

*Primary Examiner*—Renee Luebke
*Assistant Examiner*—Ann McCamey
(74) *Attorney, Agent, or Firm*—Terry L. Miller

(57) ABSTRACT

A rugged, impact-resistant electrical junction box, particularly for installation in wet environments, such as at a swimming pool, includes a non-metallic, non-conductive base part defining a cavity in which electrical wires can be terminated, and defining an opening to this cavity. A cover part is provided to close the opening of the base part. A grounding bushing member provides for electrically bonding of the junction box to metallic electrical conduits. The base part also defines a plurality of through bores through which electrical wires may pass upwardly into the cavity, and a depending tubular boss portion at each of these through bores for connection of metallic or non-metallic electrical conduits. Internally of the cavity, the base part defines a strain relief structure above and aligning with each of the plural through bores. This base part also includes an electrical bonding bar providing for plural neutral and ground conductors to be secured and mutually electrically interconnected. The bonding bar is removable from the base part to ease the connection of electrical wires to this bonding bar.

18 Claims, 8 Drawing Sheets

RUGGED ELECTRICAL JUNCTION BOX AND METHOD

FIELD OF THE INVENTION

The present invention relates to rugged and protective electrical junction boxes within which electrical wiring connections may be made. More particularly, the present invention relates to rugged and non-conductive electrical junction boxes which are useable for wiring installations including, for example, outdoor, partially subterranean, partially underwater, or weather-exposed wiring runs, to which a variety of installation circumstances may apply, and to which stringent electrical code requirements may pertain. Still more particularly, the present invention relates to an extraordinarily rugged electrical junction box which by its embodied combination, arrangement and cooperation of features allows unprecedented utility for its use in electrical wiring to light fixture installations at swimming pools.

RELATED TECHNOLOGY

Electrical junction boxes for wiring installations in wet environments are known in the pertinent art. These conventional junction boxes range from the simple, rather small metal or plastic variety used with conventional wire types, such as with Romex wire, for example, and are usable for inside residential wiring. The pertinent art also includes large, complex, and specially sealed junction boxes used in hazardous or flammable industrial environments, many times with specialized electrical cable constructions specific to the particular use.

However, few electrical wiring junction box uses are more demanding than those associated with electrical installations around swimming pools. With the proximity to water, and the necessary limited access by those not skilled as electricians (for example, access by a home owner for changing a lamp in a submerged swimming pool light fixture), the usual electrical code requirements are very demanding. Particularly, the American National Standards Institute/Underwriters Laboratories, Inc., (ANSI/UL) standard for junction boxes for swimming pool light fixtures (Standard for Safety, UL 1241), includes detailed and stringent requirements relating to all of: materials of construction; environmental sealing; electrical connections, electrical grounding, electrical bonding, and strain relief of wiring; voltage drop, available volume, and heat dissipation; as well as installation integrity factors (strength of mechanical connection between conduits and the junction box, for example).

All these standards for junction boxes usable in such environments as those around a swimming pool are intended to insure the safety of electrical wiring to lighting fixtures and to other facilities at and adjacent to swimming pools. Further, additional national standards (National Electrical Code, NFPA 70), as well as differing regional or municipal electrical code requirements may all apply to a particular swimming pool light fixture and other wiring installations. Thus, a multitude of differing combinations of code requirements may apply to swimming pool light fixture installations dependent on where they are located across the United States.

As a result, the electrical wiring industry has developed a very large number of standard junction boxes adapted to satisfy the generally applicable code requirements, to also satisfy the code requirements of certain locales, and to allow for a desired number of swimming pool light fixtures or other facilities at and adjacent to a swimming pool to be wired from the various junction boxes. Some of these conventional junction boxes are designed for use with metal (i.e., conductive) conduit (brass or aluminum, for example), while others are designed for use with nonconductive polyvinylchloride (PVC) conduit. Some junction boxes for swimming pool light installations and for other installations at or adjacent to a swimming pool are designed to satisfy the local requirements as to conduit size, or materials and will not satisfy the requirements of other localities. Some junction boxes are even custom designed and manufactured as ordered to satisfy the combination of code requirements of particular locales and to allow the desired number of light fixtures or other facilities to be wired from the junction box. That is, some locales require the use of plural junction boxes to wire a certain number of light fixtures, while another locale may allow a single standard or custom junction box to serve the same number of light fixtures. Alternatively, the expense and necessary waiting time of having a custom junction box designed and made may mitigate in favor of using plural common junction boxes to satisfy the needs of a particular swimming pool light installation, but at the expense of additional wiring and installation expense.

Further to the above, some conventional junction boxes are not sufficiently rugged as may be desired to withstand the impacts and collisions that such a box may experience at and around a swimming pool.

Still further, some locales may not allow a conventional non-metallic junction box to be used with an older installation utilizing metal (i.e., conductive) conduit. Many locales and codes require the connections at a junction box to all be bonded electrically to the metallic conduit. With conventional non-metallic junction boxes, such bonding of electrical connections within the junction box to the metallic conduit is not possible.

In view of the above, it is easy to understand why the wiring industry has developed plural swimming pool junction box designs, which are manufactured in plural sizes to meet varying installation needs. Of course, this variety in junction box designs and sizes means a great burden in junction box inventory for manufacturers and distributors, in installation logistics to insure that the right junction box design and size is available and is used at a certain job, and in inspection of wiring installations because of the multitude of codes applicable and the challenge in determining whether the junction boxes actually used out of the multitude of boxes available do in fact satisfy the plural applicable code requirements. Of course, all of this leads to a resulting increase in the chances for error and disagreement between planners, installers, and inspectors, with resulting rework of wiring installations and loss of time and productivity.

SUMMARY OF THE INVENTION

In view of the deficiencies of the related technology, it is an object for this invention to reduce or eliminate at least one of these deficiencies.

More particularly, it is an object for this invention to provide a rugged electrical junction box suitable for installation in wet environments.

Still more particularly, the rugged junction box according to the present invention has as an object the provision of a junction box structure in which a base member of the junction box in a particularly preferred embodiment is nested with a cover portion, which cover portion is formed of particularly impact resistant material.

As described above, it will be appreciated that, and recognized as an object for this invention, that the inventive junction box according to one preferred embodiment is particularly rugged because the base member and cover portion together provide a double-wall perimeter wall structure for the junction box. In this structure, the cover portion is made of an electrically non-conductive polymer that is also particularly impact resistant. Further, the base member has a perimeter wall section formed of non-conductive polymer material, and which is disposed behind (i.e., inwardly of) the perimeter wall section of the cover member, and which base member wall section backs up and reinforces the perimeter wall section of the cover portion.

It is an object for this invention to provide such a junction box with a particularly preferred embodiment having a double-wall perimeter wall structure, in which the perimeter wall structure is particularly impact and penetration resistant.

Thus, the present invention provides a non-conductive rugged electrical junction box particularly for wet environments, the junction box comprising: a body member formed of non-conductive material, the body member including a back wall and plural side walls interconnecting with one another, the back wall and side walls cooperatively defining a cavity, and the side walls having generally coplanar end edges defining an opening to the cavity; one of the side walls defining at least one depending through bore for passage of electrical wires upwardly into the junction box, and the side wall outwardly defining a depending tubular boss circumscribing the through bore; the back wall defining at least one protruding strain relief structure above and aligned generally with the through bore, and the back wall further defining a plateau structure; a bonding bar disposed at the plateau structure, and the bonding bar defining plural cross slots each having a pair of opposed arcuate grooves cooperatively defining a circumferentially interrupted screw thread for receiving a binding screw for securing and electrically connecting an electrical conductor in a respective one of the plural bonding bar slots; a cover member sealingly cooperable with the end edges of the side walls to sealingly close the cavity.

Accordingly, one embodiment of the present invention provides a rugged, impact resistant non-conductive electrical junction box particularly for wet environments, the junction box comprising: a nested two-part body formed of non-conductive material, the body including: a base part having a back wall and plural side walls interconnecting with one another, the back wall and side walls cooperatively defining a cavity, and the side walls defining an opening to the cavity; one of the side walls defining a through bore for passage of electrical wires upwardly into the junction box, and outwardly defining a depending tubular boss circumscribing the through bore; a cover member having a wall closing the opening of the base part, and the cover member including plural side walls nesting with respective side walls of the base part, so that the side walls of the base part and the side walls of the cover member form a dual wall structure along each side of the junction box. These and additional advantages of the present invention may be further appreciated from a reading of the appended detailed description of a preferred embodiment of the invention, taken in conjunction with the attached drawing figures.

BRIEF DESCRIPTION OF THE DRAWING FIGURES

FIG. 1 provides a front elevation view of a first embodiment of junction box according to the present invention, in which a portion of a cover of the box has been broken away for clarity of illustration;

FIG. 2 is a perspective view of the junction box seen in FIG. 1, again with parts broken away for clarity of illustration, and also is shown with a conduit connection and bonding structure illustrated in exploded perspective view for clarity of illustration;

FIG. 3 provides an assembled perspective view of a portion of the conduit connection and bonding structure seen in FIG. 2;

FIG. 4 provides a left side elevation view, partially in cross section, of the junction box seen in FIGS. 1 and 2

Figures 2, 3:
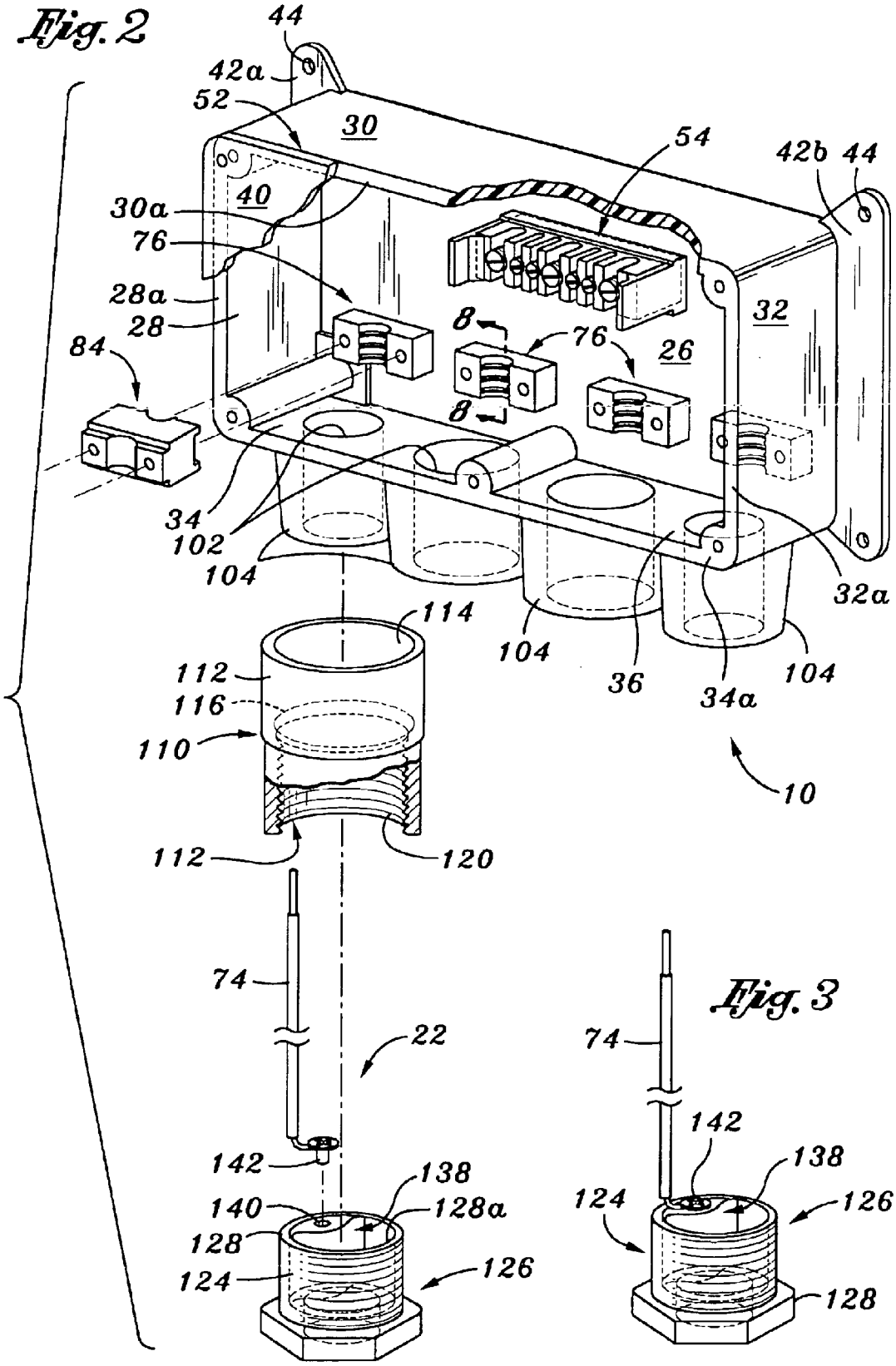
Figure 7:
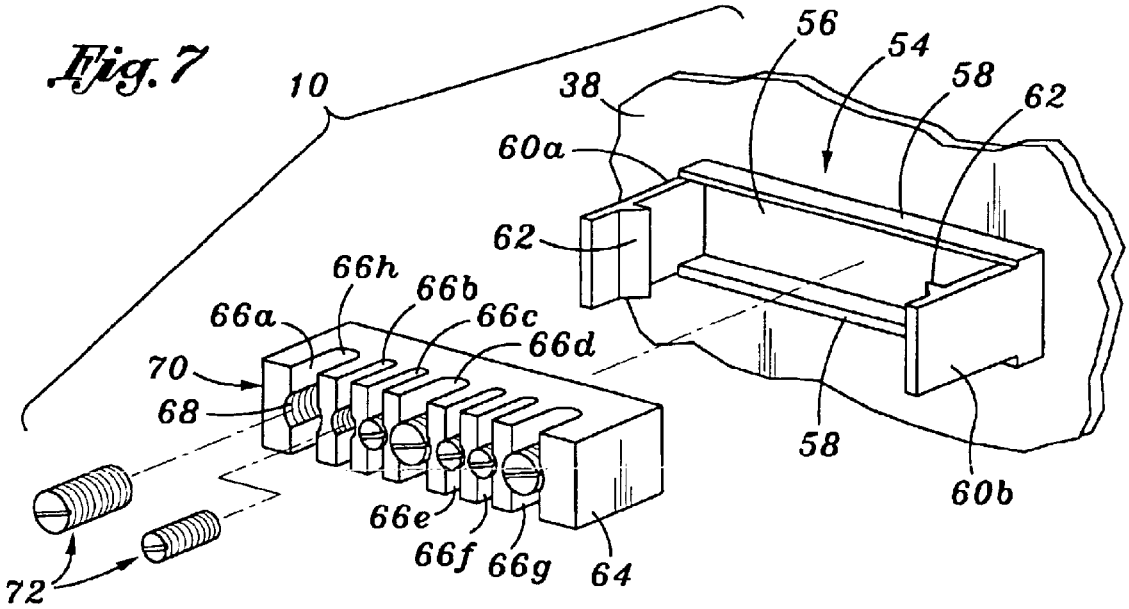
Figure 6:
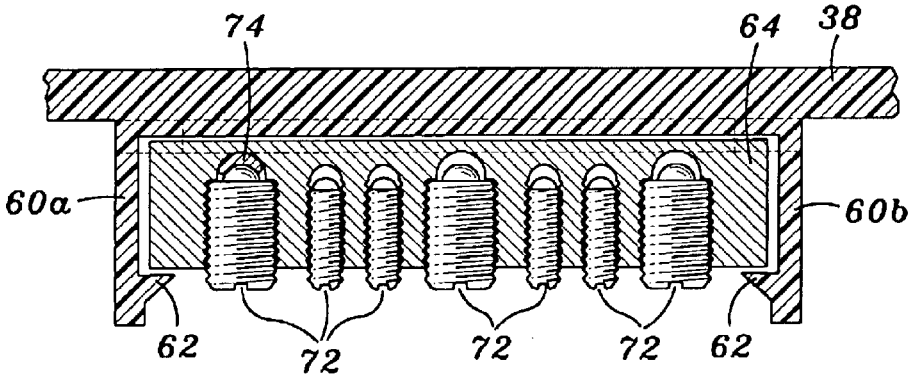
FIG. 6 is a fragmentary cross sectional view taken at line 6—6 of FIG. 1.
Figure 8:
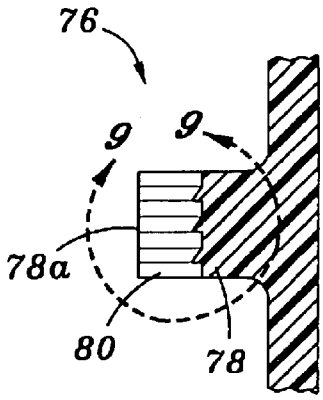
Figure 9:
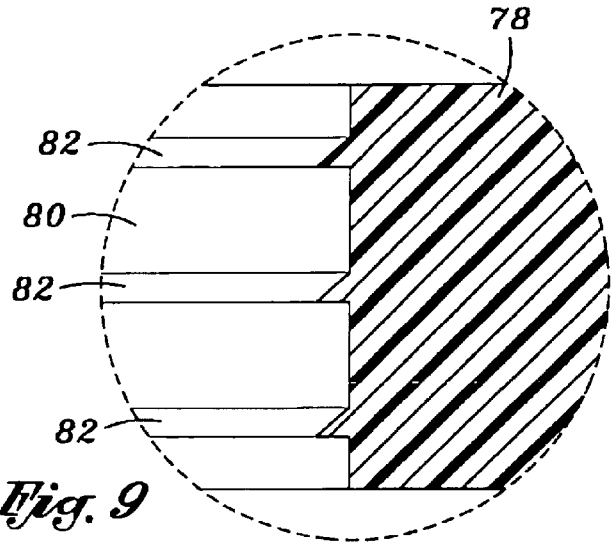
Figure 10:
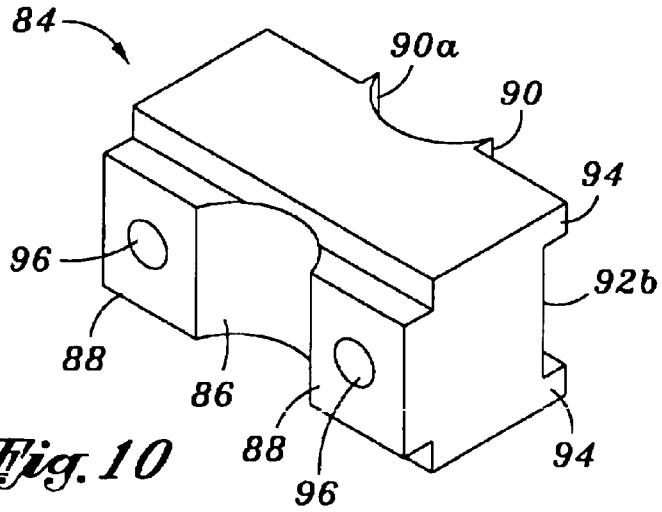
Figure 11:
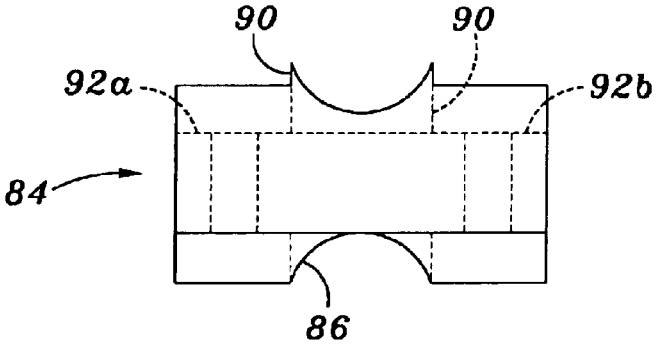
Figure 12:
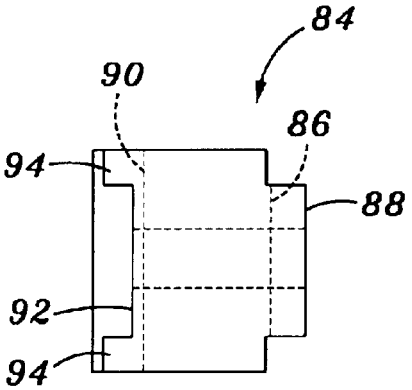
Figure 13:
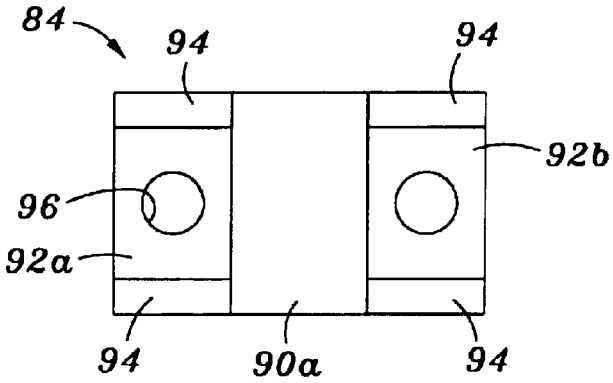
Figure 14:
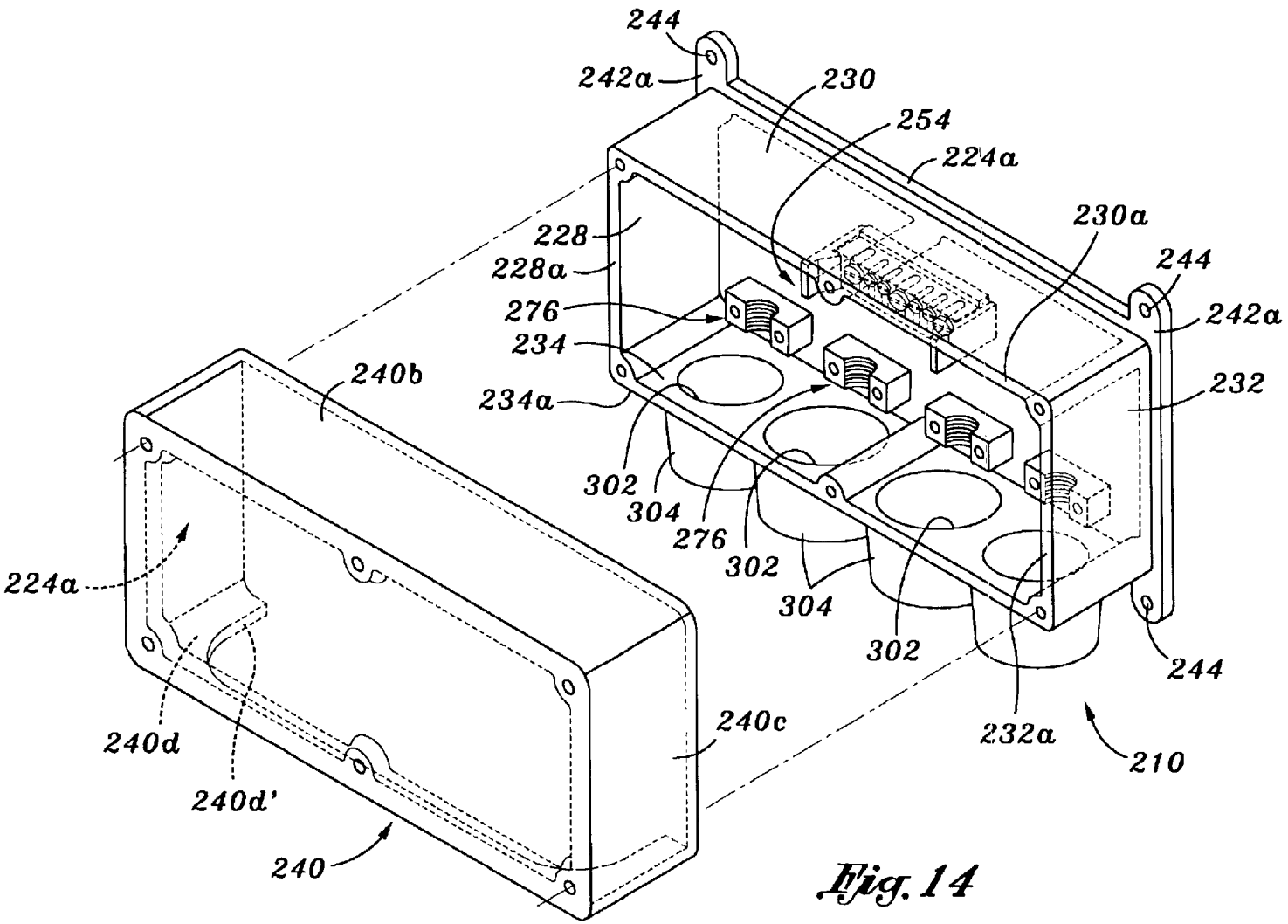
Figure 15:
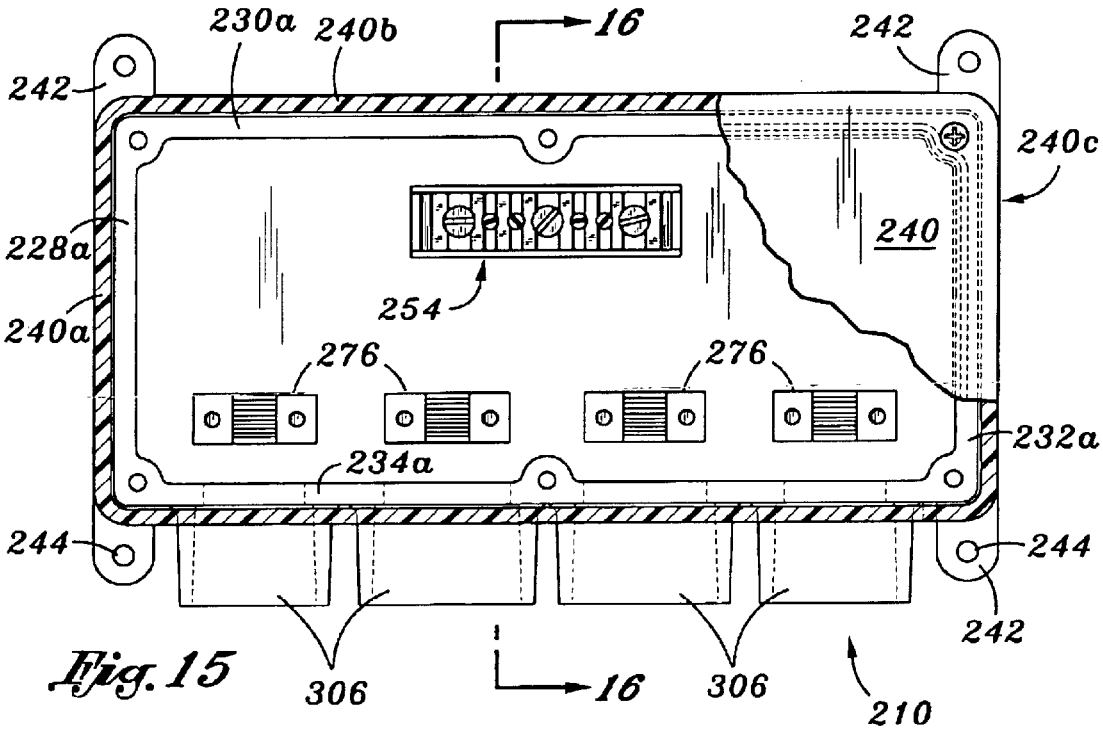
Figure 16:
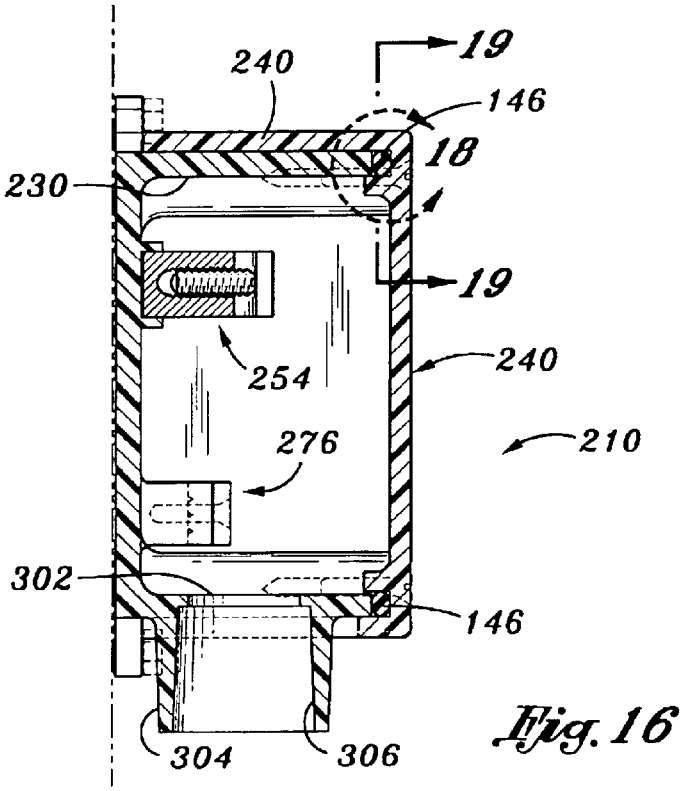
Figure 17:
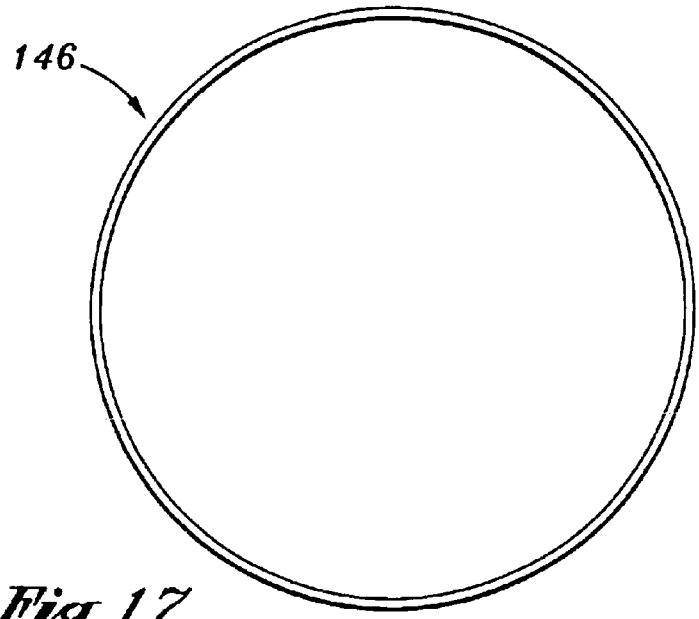
Figure 18:
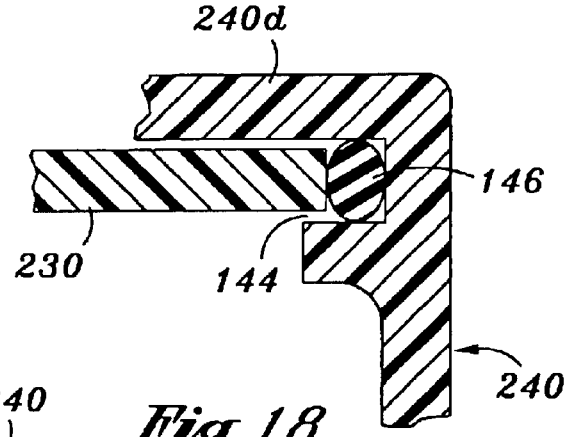
Figure 19:
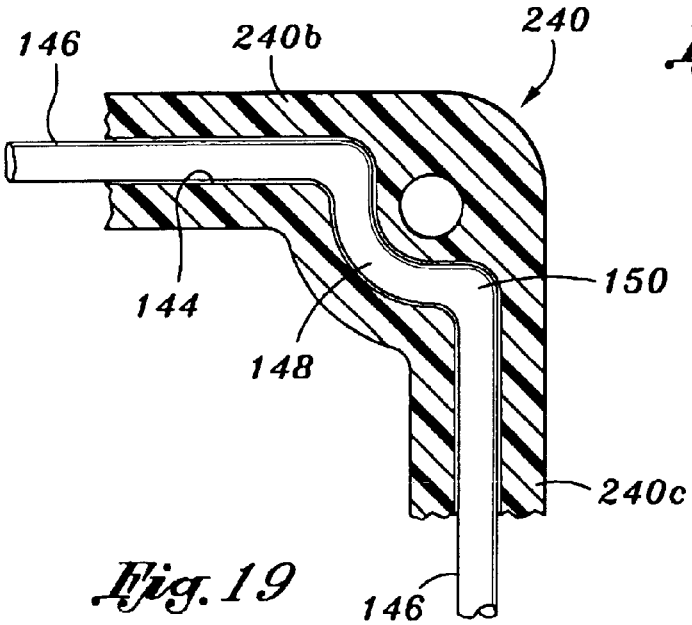

FIG. 7 provides an exploded perspective view of the portion of the junction box seen in FIG. 6;

FIG. 8 provides an enlarged cross sectional view of a strain relief feature seen in FIG. 2;

FIG. 9 is a greatly enlarged fragmentary view of an encircled portion of FIG. 8;

FIGS. 10, 11, 12, and 13, respectively, are a perspective view, a top plan view, a side elevation view, and a front elevation view, of a dual-function strain relief member of the junction box embodying this invention;

FIG. 14 provides an exploded perspective view of an alternative embodiment of junction box according to this invention;

FIG. 15 is a front elevation view, with part broken away for clarity of illustration, of the junction box seen in FIG. 14;

FIG. 16 provides a left side elevation view of the junction box seen in FIGS. 14 and 15;

FIG. 17 provides a greatly reduced plan view of a sealing member utilized in the embodiment of FIGS. 14–16;

FIG. 18 provides an enlarged fragmentary cross sectional view taken at encircled portion 18 of FIG. 17; and FIG. 19 is a greatly enlarged plan view taken at line 19—19 of FIG. 16, and at the encircled portion 19 of FIG. 15.

DETAILED DESCRIPTION OF PREFERRED EXEMPLARY EMBODIMENTS OF THE INVENTION

Figure 1:
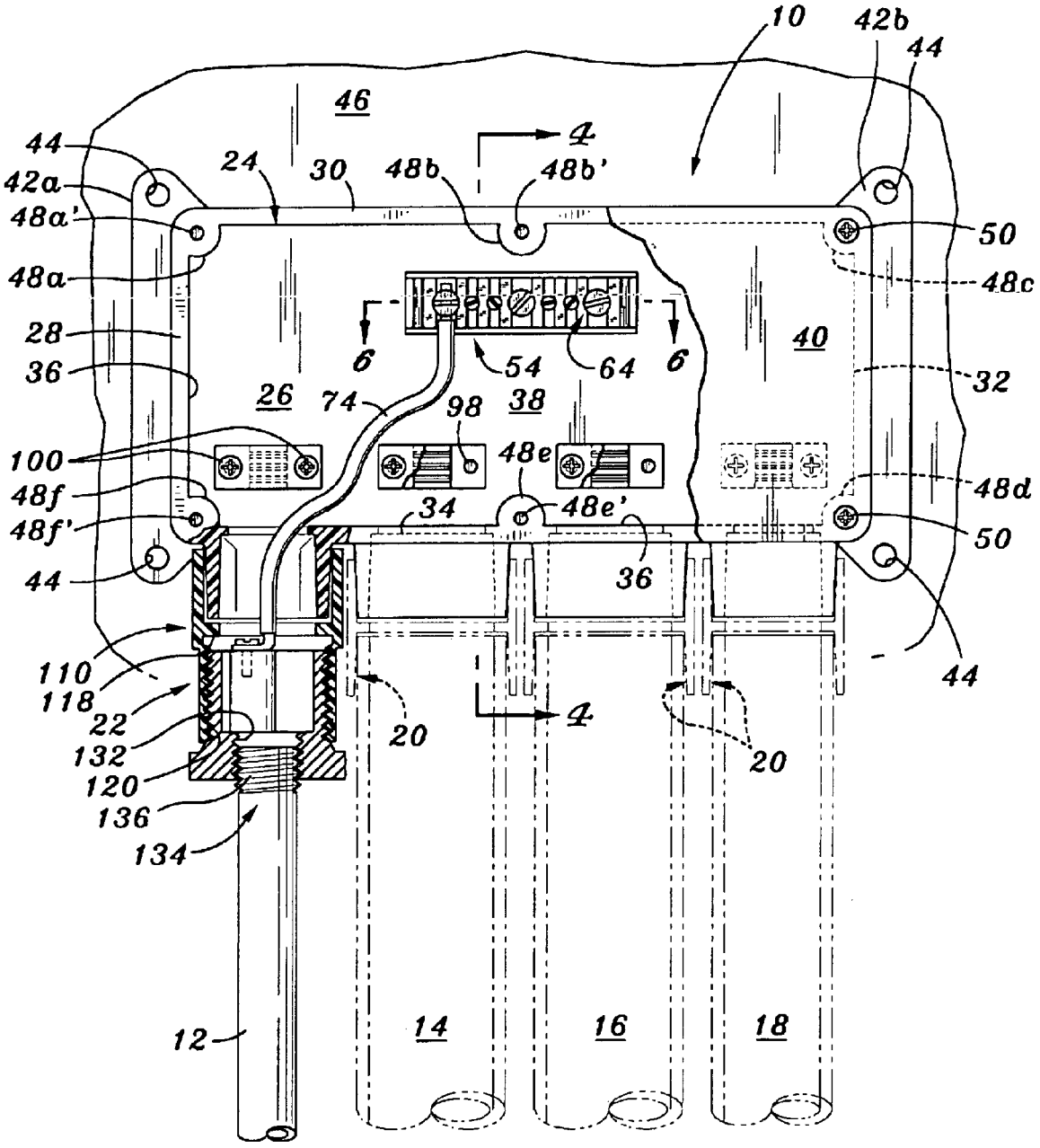

Viewing FIGS. 1 and 2 in conjunction with one another, a junction box 10 according to the invention is illustrated in front elevation view and in perspective view, respectively. The junction box 10 is disposed at the upper end of plural (four, as depicted) electrical conduits 12, 14, 16, and 18. In particular, it is to be noted that conduit 12 is a metallic (i.e., conductive) conduit. Conduits 14, 16, and 18 are non-conductive (i.e., plastic, such PVC) conduits. The junction box 10 is formed principally of non-conductive plastic material, as will be further explained. However, the junction box must be electrically bonded to the metallic conduit 12, as will be further explained. Accordingly, while each of the plastic conduits 14–18 is adhesively connected to the junction box via a plastic coupling 20, the metallic conduit 12 is both secured to and electrically bonded to the junction box 10 via a dual function coupling and bonding structure 22.

Considering the junction box 10 in overview, as is seen in FIGS. 1 and 2, this junction box includes a molded plastic body 24, having a back wall 26, and a plurality of side walls (4 in number in this embodiment, although the invention is not so limited) 28, 30, 32, and 34. The side walls 28–34 cooperatively define end edges, referenced with the numerals 28*a* through 34*a,* and these end edges define an opening 36 to a cavity 38 of the junction box 10 and provide a mounting surface for a cover member 40, to be further described below. Adjacent to the back wall 26, the body 24 includes a pair of outwardly extending flanges 42*a,* 42*b,* which each define a pair of screw holes (each indicated with the numeral 44), providing for the junction box 10 to be secured to a surface 46, as is depicted in FIG. 1 (the mounting screws for securing the junction box 10 to the surface 46 not being shown in the drawing Figures).

Adjacent to the intersections of the adjacent side walls 28–34, and intermediate of the length of the upper and lower ones of these side walls (walls 30 and 34, respectively) the body 24 defines respective ones of six (6) bosses indicated by the reference numerals 48*a* through 48*f* Adjacent to the opening 36, each of these bosses defines a respective screw hole opening at the opening 36 and extending toward the back wall 26, with the screw holes being indicated with the reference numerals 48*a*' through 48*f*'. As is fragmentarily seen in FIGS. 1 and 2, a substantially flat cover member 40 is removably secured across the opening 36 of body 24 by a corresponding plurality of screws 50 (only the heads of two of these screws being shown in FIG. 1) passing through corresponding openings of the cover 40 and threadably engaging the body 24 at the screw holes 48 of bosses 50. Most preferably, a thin, flat gasket member, indicated in FIG. 2 by the arrowed numeral 52, is interposed between the body 24 and the cover 40 in order to make the interface of the cover and body water tight.

Internally of the junction box, within the cavity 36, and forwardly extending from the back wall 26 is a plateau structure 54, best seen in FIG. 7. This plateau structure 54 includes a recess 56 (best seen in FIG. 7), defined between a pair of side walls 58 extending lengthwise of the plateau structure. Adjacent to each opposite end of this plateau structure 54 a respective latching protrusion 60*a* and 60*b* extends from the back wall 26 toward the opening of cavity 38. Each of these latching protrusions 60*a*/*b* carries a latching pawl 62. Latched into the recess 56, between the side walls 58, and between the latching protrusions 60, is an electrical bonding and grounding block or bar 64. This bonding bar 64 is preferably made of metal, and most preferably is made of brass. The bonding and grounding block or bar 64 defines a plurality of cross slots 66 (indicated with reference numerals 66*a* through 66*g* in this case, although the invention is not so limited). As is seen in FIGS. 7 and 8, each of the cross slots 66 defines a pair of opposed, arcuate grooves 68, extending into the slot from a top surface of the block 64. These grooves 68 cooperatively define a circumferentially interrupted screw thread (indicated with the arrowed numeral 70), allowing a respective binding screw 72 to be threaded into the particular slot 66, with an end of the binding screw being disposed toward a bottom end of the particular slot (all bottom ends of the slots 66 being indicated by the arrowed numeral 66*h*). The binding screws 72 are employed individually in the respective slots 66 to secure respective bonding and grounding conductors into the slots 66 (these conductors not being generally shown in the drawing Figures, but one conductor 74 in particular being illustrated in FIG. 1).

Also defined upon and integral with the back wall 26 is a plurality of strain relief structures, each indicated by the numeral 76. The strain relief structures 76 each include a boss portion 78 (best seen in FIGS. 8 and 9), which is generally rectangular in elevation view (viewing FIGS. 1 and 2), includes a top surface 78*a,* and which defines an arcuate saddle 80 traversing the top surface of this boss portion. Within the saddle 80, each boss 78 defines plural circumferentially extending engagement ribs 82, which are sized, configured, and arranged (See, FIG. 9) in order to bite into the jacket or insulation of an electrical cable or conductor in order to secure the electrical conductor or cable in the particular strain relief structure 76. To this end, each of the strain relief structures 76 includes a bi-facial cap member 84 (best seen in FIG. 2, and in FIGS. 10–13). As will be seen, the bi-facial cap member 84 on one side defines structure for engaging a larger cable jacket, and on the other side defines structure for engaging a small cable or individual conductor, both in the saddle 80 of the strain relief boss 78. Viewing now particularly FIGS. 10–13, it is seen that on one side the bi-facial cap member 84 defines a transverse arcuate recess 86 of relatively large size (i.e., in comparison to the other side of the cap member 84). This recess 86 traverses the cap structure from side to side, and interrupts a seating surface 88. The seating surface 88 is engageable with the top surface 78*a* of the strain relief boss 78. With the cap member 84 engaged on the boss 78 with the recess 86 confronting saddle 80, there is sufficient space for an electrical cable to be received at the boss 78 and to be engaged in strain relieving relationship.

On the other hand, the other side of the cap member 84 defines a slightly protruding boss 90. The boss 90 defines a transverse arcuate recess 90*a* of smaller size than the recess 86, and protruding above a seating surface 92 on the boss 90 (i.e., in comparison to the recess 86 which behind or recessed relative to the seating surface 88). This boss 90 protrudes above and interrupts the seating surface 92. Thus, the seating surface 92 is defined in two sub-parts 92*a* and 92*b,* separated by the protruding boss 90. Each of the seating surfaces 92*a* and 92*b* is bracketed between a pair of protruding side ribs 94. These side ribs 94 are spaced sufficiently apart that they straddle the boss 78 when the cap member 84 is placed on the boss 78 with surfaces 92 confronting surface 78*a*. Regardless of which way the cap member 84 is placed upon the strain relief boss 78, a pair of screw holes 96 of the cap member 84 align with a pair of screw holes 98 defined in the strain relief boss 78. As is seen in FIG. 1, a pair of screws 100 (only the screw heads of which are seen in FIG. 1) pass through the screw holes 96 of cap member 84 and threadably engage into the screw holes 98 of the boss 78 to removably and adjustably secure the cap member, and to clamp the electrical conductors or cables received at each strain relief boss 78.

Figure 4:
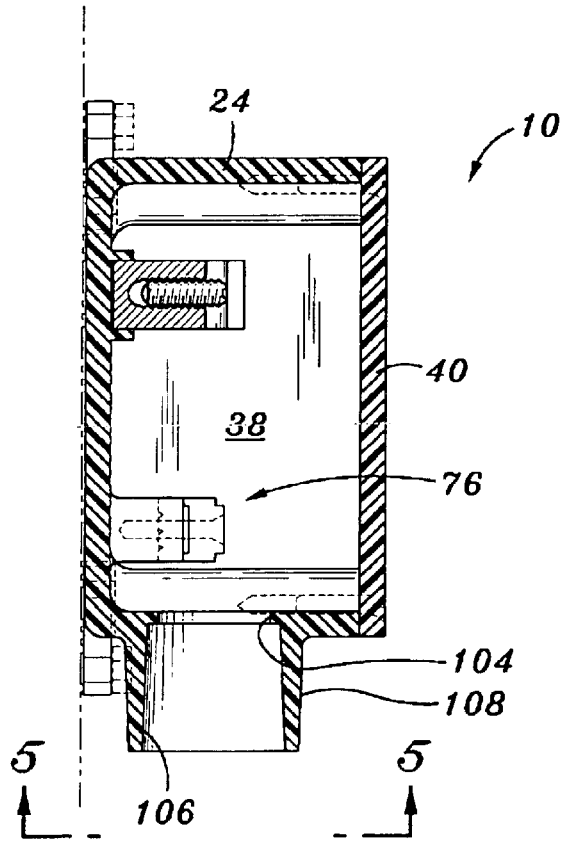
Figure 5:
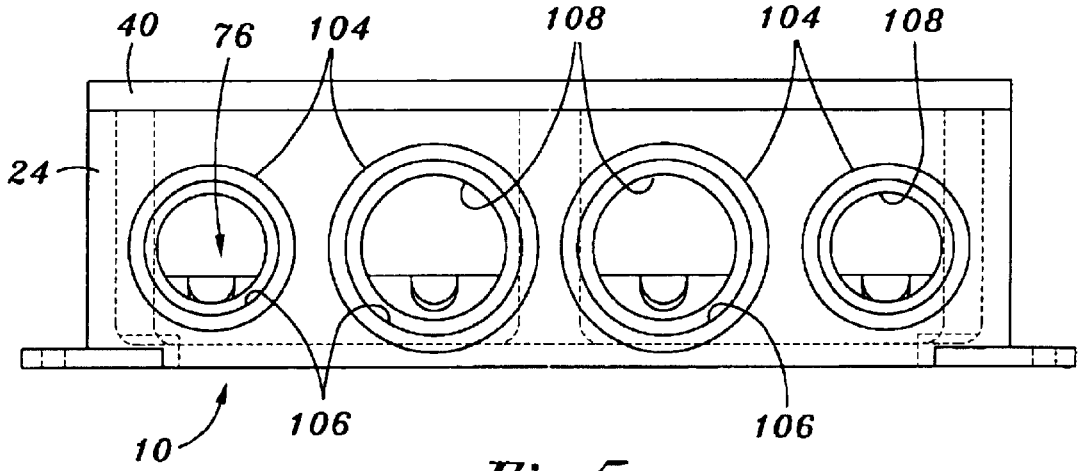
FIG. 5 is an underside plan view (viewed looking upwardly) of the junction box seen in FIGS. 1, 2, and 4.

Returning to a consideration of FIGS. 1 and 2, and also considering FIGS. 4 and 5, it is seen that the lower side wall 34 of the body 24 defines four circular openings 102, each aligning with a respective one of the strain relief structures 76. Externally, the wall 34 defines and carries a respective outwardly extending tubular combination conduit socket and boss member 104. That is, internally, each boss 104 defines a substantially straight counter bore 106 ending at a circumferential shoulder 108 (viewing FIGS. 4 and 5, for example), and this bore 106 is sized to receive and have adhesively secured therein an end portion of an electrical conduit (not seen in the drawing Figures). On the other hand, the bosses 104 are each externally sized to receive thereover and to adhesively secure to a coupling member 20, recalling the explanation of FIG. 1 set out above.

Considering FIGS. 1 and 2 in greater detail, the construction of a specialized coupling member 110 of the coupling and bonding structure 22 is depicted. This coupling member 110 includes a tubular body 112, which at an upper end defines a substantially straight bore portion 114 leading to a circumferential rib 116. The rib 116 defines a shoulder 118 for the bore portion 114. As is seen in FIG. 1, the coupling member 110 is receivable onto and may adhesively secure to one of the bosses 104, just as do the couplings 20. However, the body 112 of this coupling member 110 defines an opposite bore portion 120 leading from the rib 116 to open oppositely on the body 112. This bore portion 120 defines an internal thread 122, into which is threadably engaged an external thread 124 of a bonding bushing member 126.

As FIGS. 1, 2 and 3 illustrate, the bonding bushing member 126 is metallic (i.e., conductive) and has a tubular body 128 defining a stepped through bore 128*a*. A reduced diameter portion 130 of the bore 128*a* defines a thread 132 which is threadably engageable with the metallic conduit 12, recalling FIG. 1. That is, the upper portion 134 of the metallic conduit 12 defines and external thread 136 threadably engaging the internal thread 132 of the bonding bushing member 126. Thus, the bonding bushing member 126 is electrically conductive with the metallic conduit 12. In order to provide a structure for electrically connecting the bonding bushing member 126 with the bonding bar 64, the bonding bushing member 126 defines an internally protruding rounded boss 138 on the bore 128*a,* This boss 138 still leaves adequate room in the bore 128*a* for electrical cables or conductors to pass through the bonding bushing member 126. At an upper extent of this rounded boss 138, the boss defines an axially extending screw hole 140 (viewing FIG. 2), and a bonding screw 142 it threadably receivable into this screw hole 140 in order to secure and electrically connect a bonding conductor 74, recalling the explanation above of the connection of this conductor to bonding bar 64.

Turning now to FIGS. 15–19 taken in conjunction with one another, an alternative embodiment of a junction box according to this invention is depicted. Because this alternative embodiment of junction box has many features in common with the first disclosed embodiment of junction box, these features are indicated on FIGS. 15–19 using the same numeral employed above, and increased by two hundred (200). Viewing first FIG. 15, it is seen that the junction box 210 includes a body 224 which in many respects is similar to the body 24. One difference between the body 24 and the body 224 is that the latter has an outwardly protruding flange portion 224*a* completely circumscribing the side walls 228–234. As will be seen, this flange portion provides for the cover part 240 of the junction box to nest over the side walls 228–234 while the cover member 240 is still entirely within the "foot print" of the box 210 in elevation view (i.e., as is seen in FIG. 15). Another important difference for the junction box 210 is that the cover member 240 includes circumferential side walls 240*a* through 240*d,* which side walls of this cover part nest over the side walls of the body 224. The side walls of the body 224 and the side walls of the cover part 240 are a close sliding fit with one another, so that the side walls of the body and cover reinforce one another with respect to externally applied forces and impacts, as will be further explained. The side wall 240*d* of the cover member 240 defines an elongate recess 240*d*' which closely embraces the bosses 304 on the wall 234 of the body 224.

As is best seen in FIGS. 15–19, the cover member 240 inwardly defines a circumferential seal raceway or seal groove 144. This seal groove 144 opens toward the body 224 of the box 210, toward the top or end edges 228*a*–234*a* of the side walls 228–234. Received into this seal raceway 144, is an O-ring type of seal member 146, as is seen in FIG. 17. The seal member 146 is round in cross section, and is also round in plan view (see, FIG. 17), and is an inexpensive common O-ring type of seal member. However, because the seal raceway 144 is especially configured to receive and retain the O-ring seal member 146, this seal member acquires and defines a substantially rectangular sealing line with the side walls 228*a*–234*a,* as is seen in FIG. 15 particularly. That is, the seal member 146 has a generally rectangular sealing line with the box body 224, but includes reverse bend or reentrant arcuate sections at the corners of this box body 224, as is more fully explained below.

Viewing FIGS. 16 and 18, it is seen that the seal raceway 144 of the cover member 240 receives an outer extent of the side walls 228–234, so that the end surfaces 228*a*–234*a* are actually received a short distance into this seal raceway 144. Thus, the O-ring seal member 146 is captively received in this seal raceway when the cover member 240 is engaged on the box body 224, as is seen in FIGS. 16 and 18. However, as is seen in FIG. 19, the seal raceway 144 defines a reentrant or reverse arcuate curve portion 148 adjacent to the corner securing screws of the cover member 240. Accordingly, the seal member 146 is curved around and clear of the locations of the screws securing the cover 240 at the corners of the box 210. These reentrant curve portions 148 are joined with the adjacent substantially straight runs of the seal raceway 144 (i.e., extending parallel with the straight side walls 228–234 of the box 210) by transition corners 150 of rather short radius. Because the transition corners 150 distort the O-ring seal member 146 to a shorter radius bend that it naturally has in its undistorted shape (recalling FIG. 17), while the reentrant curve portions 148 intermediate of these transition corners force the O-ring seal member into a bend in the direction opposite to its natural curvature, the O-ring seal member tends to self-bind or self-retain in the corners of the cover member 240. The result is that the round plan form O-ring seal member 146 is received into the seal member raceway 144 and is retained there sufficiently that it does not easily or inadvertently fall out of the cover member 240 even when this cover member is removed from the box body 224.

Consequently to the above, at initial installation of the junction box 210, the installation technician places the O-ring seal member 146 into the raceway groove 144, and it will stay there sufficiently well that the cover 240 may be installed on the body 224 with no great risk that the seal member 146 will fall out of place during handling of the cover 240. Further, if after such an initial installation of the junction box 210, it is necessary to remove the cover member 240, the seal member 146 will then also be retained sufficiently that it does not inadvertently fall from the cover 240. Ordinarily in the event that the cover member 240 is removed from body 224 after some time, then a new seal member 146 will be installed into the cover 240 before the cover is returned to its place on the body 224.

Further to the above, in the use of a junction box embodying the present invention, it is to be understood that plural electrical cable or conductor interconnections may be effected within the junction box. Additionally, the present inventive junction box is particularly rugged. Particularly, the second inventive embodiment of this present junction box is resistant to impacts, both on the top of the cover and particularly on the side of the box. Considering the second embodiment of the present junction box, it is seen that the side walls of the body and the side walls of the cover nest with one another, so that the side walls of the body backup and reinforce the side walls of the cover. In this structure of layered (i.e., two layers or levels of side wall) the side walls of the body may be made of a material that is tough but not particularly able to withstand sharp fracturing impacts. On the other hand, the cover member may be made of a material able better to withstand sharp fracturing impacts. The combination of these two side wall layers gives better impact resistance than either side wall structure could provide were it used alone. An example of a material that is particularly preferred for the cover member 240 is Lexan™.

While the present invention has been depicted and described by reference to two particularly preferred embodiments of the invention, such reference does not imply a limitation on the invention, and no such limitation is to be inferred. The invention is capable of considerable variation and alteration in its embodiments without departing from the invention. Accordingly, the invention is intended to be limited only by the spirit and scope of the appended claims, giving cognizance to equivalents in all respects.

We claim:

1. A non-conductive rugged electrical junction box particularly for wet environments, said junction box comprising:

a body member formed of non-conductive material, said body member including a back wall and plural side walls interconnecting with one another, the back wall and side walls cooperatively defining a cavity, and said side walls having generally coplanar end edges defining an opening to said cavity;

one of said side walls defining at least one depending through bore for passage of electrical wires upwardly into said junction box, and said side wall outwardly defining a depending tubular boss circumscribing said through bore;

said back wall defining at least one protruding strain relief structure above and aligned generally with said through bore, and said back wall further defining a plateau structure;

a bonding bar disposed at said plateau structure, and said bonding bar defining plural cross slots each having a pair of opposed arcuate grooves cooperatively defining a circumferentially interrupted screw thread for receiving a binding screw for securing and electrically connecting an electrical conductor in a respective one of said plural bonding bar slots;

a cover member sealingly cooperable with said end edges of said side walls to sealingly close said cavity.

2. The junction box of claim 1 further including a bonding bushing structure, said bonding bushing structure including a tubular metallic body defining a through bore, a lower reduced diameter portion of said through bore defining a thread which is threadably engageable with and electrically conductive with a metallic conduit, an internally protruding rounded boss on said through bore, said boss of said bushing member at an upper extent defining an axially extending screw hole for threadably receiving a bonding screw to secure and electrically connect a bonding conductor.

3. The junction box of claim 1 wherein said bonding bar is removably disposed at said plateau structure.

4. The junction box of claim 3 wherein said dual function strain relief and grounding wire connection means includes a pair of upright spaced apart stanchion members bracketing said through bore.

5. The junction box of claim 3 wherein said plateau structure includes a recess defined cooperatively by a pair of spaced apart side walls and a pair of spaced apart latching protrusions, said pair of latching protrusions each carrying a respective one of a pair of latching pawls disposed toward one another and engageable with said bonding bar.

6. The junction box of claim 5 wherein said plural cross slots of said bonding bar are disposed generally vertically to receive in said plural cross slots respective conductors extending generally vertically from said at least one depending through bore.

7. A bonding bushing structure, said bonding bushing structure including:

a coupling member including a tubular body of non-conductive adhesively bondable polymer, said tubular body defining a stepped through bore at an upper end defining a substantially straight bore portion for receiving and adhesively bonding to a depending boss of a junction box, a circumferential rib on said through bore separating said straight bore portion from a lower bore portion defining a thread threadably engaging with a metallic bonding bushing;

said metallic bonding bushing including a tubular metallic body defining a respective through bore, a lower reduced diameter portion of said respective through bore defining a thread which is threadably engageable with and electrically conductive with a metallic electrical conduit, an internally protruding rounded boss on said respective through bore, said boss of said bushing member at an upper extent defining an axially extending screw hole for threadably receiving a bonding screw to secure and electrically connect a bonding conductor.

8. A method of internally electrically bonding a non-conductive electrical junction box to a metallic electrical conduit, said method comprising steps of:

providing a metallic bonding bar within said non-conductive electrical junction box; and utilizing said bonding bar to electrically connect neutral and ground conductors terminating within said electrical junction box;

providing said electrical junction box with a coupling member including a tubular body of non-conductive adhesively-bondable polymer, adhesively bonding said tubular body at an opening of said non-conductive electrical junction box;

providing said tubular body with a through bore with a lower bore portion;

at said lower bore portion defining a thread threadably engaging with a metallic bonding bushing;

providing said metallic bonding bushing including a tubular metallic body defining a respective through bore, at a lower reduced diameter portion of said respective through bore defining a thread threadably engaging with and electrically conductive with said metallic electrical conduit, internally securing to said tubular metallic body of said bonding bushing member and within said respective through bore an electrical bonding conductor, and extending said bonding conductor internally of said through bore of said coupling member into said junction box to and securing in electrical connection with said bonding bar.

9. The method of claim 8 further including the steps of defining within said metallic bonding bushing a rounded inwardly protruding boss, and electrically securing said bonding conductor to said metallic bonding bushing by use of a screw threadably engaging into said boss.

10. A rugged, impact resistant non-conductive electrical junction box particularly for wet environments, said junction box comprising:

a nested two-part body formed of non-conductive material, said body including:

a base part having a back wall and plural side walls interconnecting with one another, said plural side walls of said base part each having a depth dimension extending perpendicularly to said back wall, the back wall and side walls cooperatively defining a cavity, and said side walls defining an opening to said cavity;

one of said side walls defining a through bore for passage of electrical wires upwardly into said junction box, and outwardly defining a depending tubular boss circumscribing said through bore;

a cover member having a front wall closing said opening of said base pan, and said cover member including respective plural side walls nesting with side walls of said base part, said respective plural side walls of said cover member each having a respective depth dimension extending perendicularly to said front wall, which respective depth dimension is substantially similar to said depth dimension of said plural side walls of said base part, so that said side walls of said base part and said respective side walls of said cover member nest with one another to form a dual perimeter wall structure along at least part of each side of said junction box, said dual perimeter wall structure being a major fraction of said depth dimension of said plural side walls of said base part and said cover member, whereby said side walls of said base part and of said cover member mutually support one another to resist impact force applied to aside wall of said junction box.

11. The junction box of claim 10 further including said one side wall defining plural through bores, each with a depending tubular boss outwardly disposed on said base part.

12. The junction box of claim 10 further including a bonding bushing structure, said bonding bushing structure including a tubular metallic body defining a through bore, a lower reduced diameter portion of said through bore defining a thread which is threadably engageable with and electrically conductive with a metallic conduit, an internally protruding rounded boss on said through bore, said boss of said bushing member at an upper extent defining an axially extending screw hole for threadably receiving a bonding screw to secure and electrically connect a bonding conductor.

13. The junction box of claim 10 wherein said back wall defines plural protruding strain relief structures, each disposed above and aligned generally with each of said plurality of through bores.

14. The junction box of claim 13 wherein said back wall further carries a plateau structure, said plateau structure including a recess defined cooperatively by a pair of spaced apart side walls and a pair of spaced apart latching protrusions, said pair of latching protrusions each carrying a respective one of a pair of latching pawls disposed toward one another and engageable with a bonding bar, a bonding bar member received removably at said plateau structure, and said bonding bar member providing for plural neutral and ground electrical conductor to be secured and mutually electrically interconnected.

15. The junction box of claim 14 said bonding bar member defines plural cross slots disposed generally vertically to receive in said plural cross slots respective conductors extending generally vertically from said plurality of through bores.

16. The junction box of claim 15 wherein said bonding bar member defines plural cross sots each having a pair of opposed arcuate grooves cooperatively defining a circumferentially interrupted screw thread for receiving a binding screw, said binding screws securing and electrically connecting an electrical conductor in a respective one of said plural slots of said bonding bar member.

17. A method of providing a rugged, particularly impact resistant, non-conductive electrical junction box, said junction box offering particular utility for installation in wet environments, said method comprising steps of:

providing a nested two-part junction box body having a depth dimension, with each of said two part of said body being formed of non-conductive material;

configuring said junction box body by the steps of:

forming a base part having a back wall and plural side walls interconnecting with one another, the back wall and side walls cooperatively defining a cavity, and said side walls extending perpendicularly from said back wall substantially said depth dimension and defining an opening to said cavity;

providing for one of said side wails to define a through bore for passage of electrical wires upwardly into said junction box, and outwardly defining a depending tubular boss circumscribing said through bore;

providing a cover member having a front wall closing said opening of said base part, and providing for said cover member to include plural respective side walls each also extending perpendicularly to said front wall substantially said depth dimension and nesting with side walls of said base part; and sliding said base part and said cover member into nesting relation so that said side walls of said base part and said respective side walls of said cover member form a perimeter dual wall structure along at least a part of each side of said junction box, and said perimeter dual wall structure defining a major fraction of said depth dimension.

18. The method of claim 17 further including the step of providing a strain relief structure within said cavity and generally aligning with each of said plural through bores, and providing for said strain relief structure to include a bi-facial cap member on each side defining one of a pair of transverse arcuate recesses each of differing size from one another.

* * * * *